United States Patent [19]

Guichon

[11] Patent Number: 5,044,691

[45] Date of Patent: Sep. 3, 1991

[54] MONOLITHIC ARMCHAIR MADE OF INJECTED PLASTIC MATERIAL, STACKABLE WITH SMALL PITCH

[75] Inventor: Jean-Paul Guichon, Saint Lupicin, France

[73] Assignee: Grosfillex S.A.R.L., Arbent, France

[21] Appl. No.: 485,141

[22] Filed: Feb. 26, 1990

[30] Foreign Application Priority Data

Mar. 1, 1989 [EP] European Pat. Off. ..... 8900563.6

[51] Int. Cl.[5] ..... A97L 3/00

[52] U.S. Cl. ..... 297/239; 297/457; 297/DIG. 2

[58] Field of Search ..... 297/193, DIG. 2, 452, 297/457, 239

[56] References Cited

U.S. PATENT DOCUMENTS

| | | | |
|---|---|---|---|
| 1,408,114 | 2/1922 | Mathieu | 297/239 |
| 2,736,826 | 5/1960 | Reineman | 297/457 X |
| 3,173,723 | 3/1965 | Hoven et al. | 297/DIG. 2 |
| 3,874,726 | 4/1975 | Sebel et al. | 297/239 |
| 4,341,419 | 7/1982 | Sebel | 297/239 |
| 4,856,845 | 8/1989 | Massonnet | 297/457 X |

FOREIGN PATENT DOCUMENTS

| | | | |
|---|---|---|---|
| 1529443 | 5/1969 | Fed. Rep. of Germany | 297/239 |
| 2084458 | 4/1982 | United Kingdom | 297/DIG. 2 |

*Primary Examiner*—Peter A. Aschenbrenner
*Attorney, Agent, or Firm*—Poms, Smith, Lande & Rose

[57] ABSTRACT

This invention relates to a monolithic armchair made of injected plastics material, stackable with small pitch and comprising various elements constituted by a seat element with subjacent reinforcing projections, a backrest, four legs and armrests, said elements presenting substantially horizontal parts and substantially vertical parts, the latter being inclined, forming between their line of greatest slope and the vertical, a so-called stacking angle (a), wherein the stacking angle (a) is included between 8° and 15° in order to reduce the pitch of stacking, join of the legs with the seat element, the armrests and the backrest being effected by reinforced fit and stiffening means included within this limited pitch.

15 Claims, 3 Drawing Sheets

2
3
17
6
9
18
16
1
12
7
4
4
5
a 2
3
3
p
17
f
1
h
12
4
13
5
5
a
4
14

MONOLITHIC ARMCHAIR MADE OF INJECTED PLASTIC MATERIAL, STACKABLE WITH SMALL PITCH

FIELD OF THE INVENTION

The present invention relates to a stackable monolithic armchair made of injected plastics material, said armchair comprising a seat element, a backrest and two armrests integral with four legs.

BACKGROUND OF THE INVENTION

Such known armchairs comprise so-called vertical "faces" which correspond to the legs, backrest, armrests, edges and ribs of the seat element, etc. . . . and so-called horizontal "faces" which correspond to the seat element and other elements which are substantially parallel thereto. For such armchairs to be stackable, it is necessary in particular that the lines of greatest slope of the so-called vertical faces form a particular angle of fit with respect to the vertical; this angle determines the pitch of stacking as a function of the thickness of these so-called vertical faces and when the so-called vertical faces of the stacked armchairs are in contact with one another; of course, the height of the seat element with its subjacent projections must be less than said pitch, otherwise it determines the latter by abutment.

Numerous models of such a known armchair exist, probably around two hundred, and they may be classified in several types depending on the orientation of the legs.

A first type comprises legs with a section in the form of a rearwardly open V for the rear legs and forwardly open V for the front legs.

A second type comprises rearwardly open V-sectioned front legs, whilst the V-sectioned rear legs are open on the sides.

According to a variant, the rear legs are sectioned in the form of angles open on the sides as well as rearwardly.

A third type comprises legs sectioned as angles open on the sides and forwardly for the front legs and rearwardly for the rear legs.

These armchairs made of moulded plastics material must satisfy numerous imperatives: aesthetics, stability and strength, comfort, aptitude to support, in complete safety, heavy persons or to withstand ill-advised stresses such as tipping on one or two legs, possibility of stacking them for transport and storage, facility of unstacking them, avoiding jamming, minimum storage and transport costs, competitive cost price, . . . . .

In order to conciliate all these imperatives, rules of practice are observed by all manufacturers. For example, the minimum thickness of the legs is of the order of 6 mm and the angle of said legs with respect to the vertical is included between 5 and 8 degrees without ever exceeding this maximum value.

With such rules, it is possible to make a pile of 30 armchairs at a pitch of about 60 mm; this pile, enclosed in a cover, is 2.30 m high, compatible with the free height of the means of transport used.

It is an object of the present invention to increase the storage and transport capacity in order to reduce the cost of these services. The problem to be solved in order to attain this purpose is that of reducing the pitch of stacking.

Once the problem has been set forth, the invention appears obvious. In fact, it suffices to reduce the thickness slightly and to increase the angle of stacking that the line of greatest slope of the so-called vertical faces makes with the vertical, which angle is limited by practice to 8 degrees.

In that case, Directive C-IV 94-i concerning the examination carried out at the European Patent Office indicates that the inventive activity must be assessed at the level of the formulation of the idea or of a problem to be solved.

SUMMARY OF THE INVENTION

Under these conditions, the characteristic of the invention whereby the angle of stacking is included between 8 and 15 degrees in order to reduce the pitch of stacking, presents the required inventive activity, since the latter must be assessed according to the above-mentioned Directive, not at the level of the characteristic itself which appears obvious, but at the level of the problem to be solved which seems never to have been raised.

This characteristic must of course be combined with another characteristic of the invention which also appears obvious, whereby the join of the legs with the seat element, the armrests and the backrest must be effected by reinforced fit and strengthening means included within this limited pitch of stacking. This other characteristic involves the required inventive activity, not per se but at the level of the problem to be solved, since, by reducing the pitch of stacking, the height of the subjacent elements of the seat element intended for strengthening the join thereof with the legs is reduced and the fits must in that case be reinforced.

To obtain such reinforcement, various combined means may be carried out.

Firstly, the extent of the attachments of the elements which end at the legs must be increased.

To that end, the third type of chair is selected and the seat element which is dish-shaped presents:

in downward projection, a front edge and two side edges, as well as ribs which are parallel thereto, in upward projection, a rounded part for joining with the backrest and, downwardly, a rear rib which is parallel thereto, and, upwardly, the front rising parts of the armrests, all these edges, ribs, rear rounded joining part and rising parts of armrests being integral with the flanges of the angles forming the legs.

To that same end, the width of the flanges of the legs at the level of the upper apparent surface of the seat element, i.e. at the root, is included:

between 85 and 115 mm for the transverse flanges and 75 and 105 mm for the antero-posterior flanges of the front legs, between 60 and 90 mm for the transverse flanges and 75 and 105 mm for the antero-posterior flanges of the rear legs.

According to a particularly advantageous embodiment, the width of the transverse flanges of the front legs measures substantially 95 mm and that of the antero-posterior flanges substantially 85 mm, whilst the width of the transverse flanges of the rear legs measures substantially 70 mm and that of the antero-posterior flanges substantially 85 mm.

Each rising armrest part is sectioned as an angle whose transverse flange extends the marginal part of that of the corresponding front leg and whose antero-posterior flange extends a re-entrant recessed part of the corresponding lateral edge of the seat element.

The dish-shaped seat element presents in the median transverse direction a camber (F) substantially equal to 26 mm for a bearing surface (p) substantially equal to 430 mm and a thickness of between 3 and 4 mm.

The ribs present a height (h) substantially equal to 23 mm and are spaced from the edges by a distance of between 80 and 50 mm.

This particular configuration enables the desired reinforcement to be obtained.

However, it may be thought that the reinforcement thus obtained will not prevent the armchair from being deformed a little, but that this armchair will, despite that, be sufficiently resistant to oppose the various stresses to which it is usually subjected.

The inventive activity also resides in the idea whereby the resultant suppleness of the armchair should be perfectly accepted by the user, contrary to the pre-conceived idea that the user imperatively seeks rigidity and undeformability. The complementary idea which justifies the inventive activity is therefore that the suppleness and deformability of the chair are properties that should please the user on condition that safety is ensured (no break, nor tilt).

Once this idea has been set forth, the means to be carried out are obvious: increase of the angle of the legs and acceptation of fits which are just sufficient; the inventive activity then lies, not at the level of these means, but, according to the Directive mentioned above, at the level of the formulation of the idea set forth hereinabove.

It should be noted that these two inventive ideas, which are apparently different: reduction of the pitch of stacking and increase in the suppleness of the armchair, are combined and unitary at the level of the means carried out.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
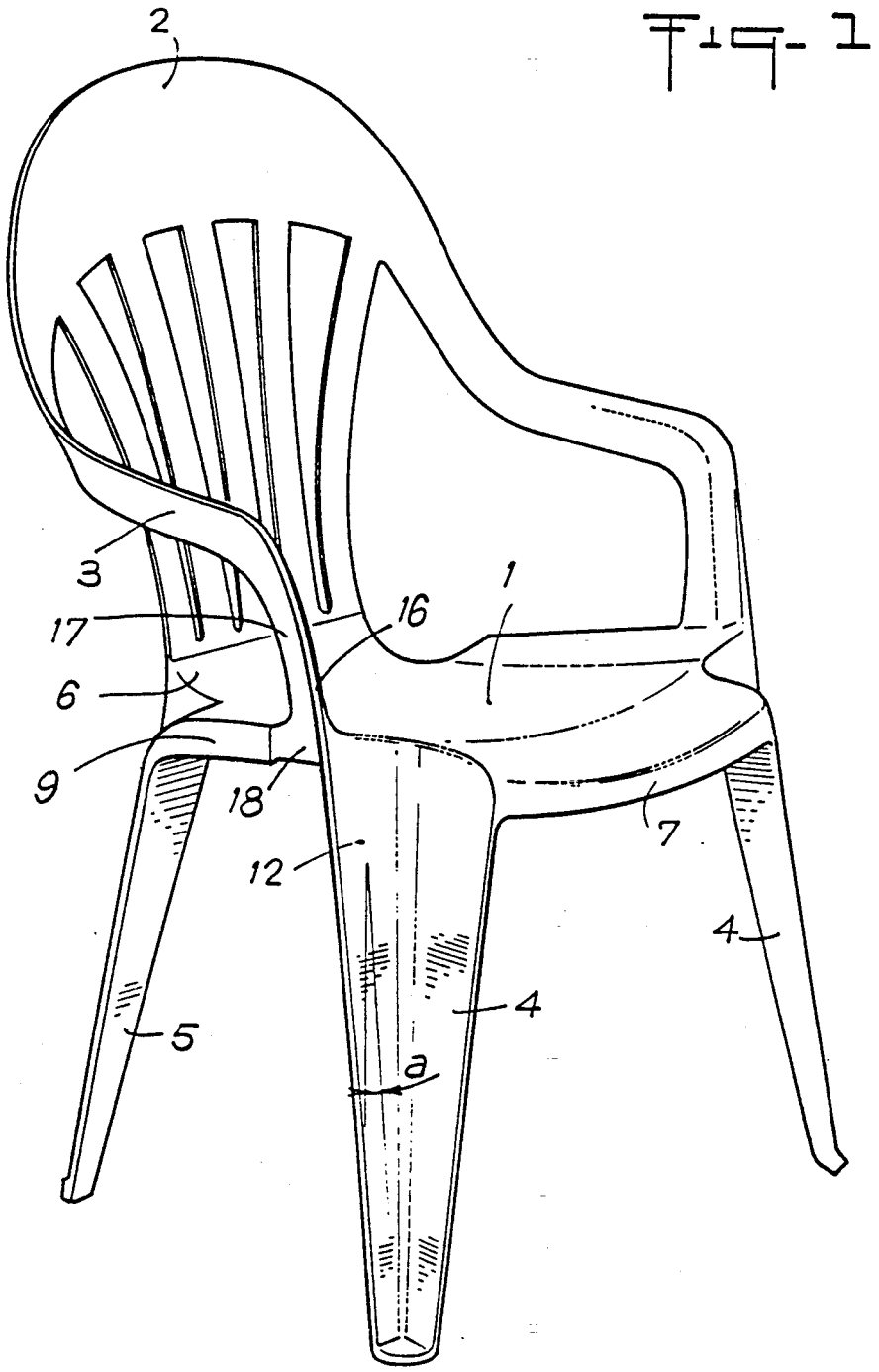
FIG. 1 is a perspective view illustrating an armchair according to the invention.

Referring now to the drawings, the armchair is monolithic and made of injected plastics material. It comprises a seat element 1, a backrest 2, armrests 3, front legs 4 and rear legs 5.

Figure 2:
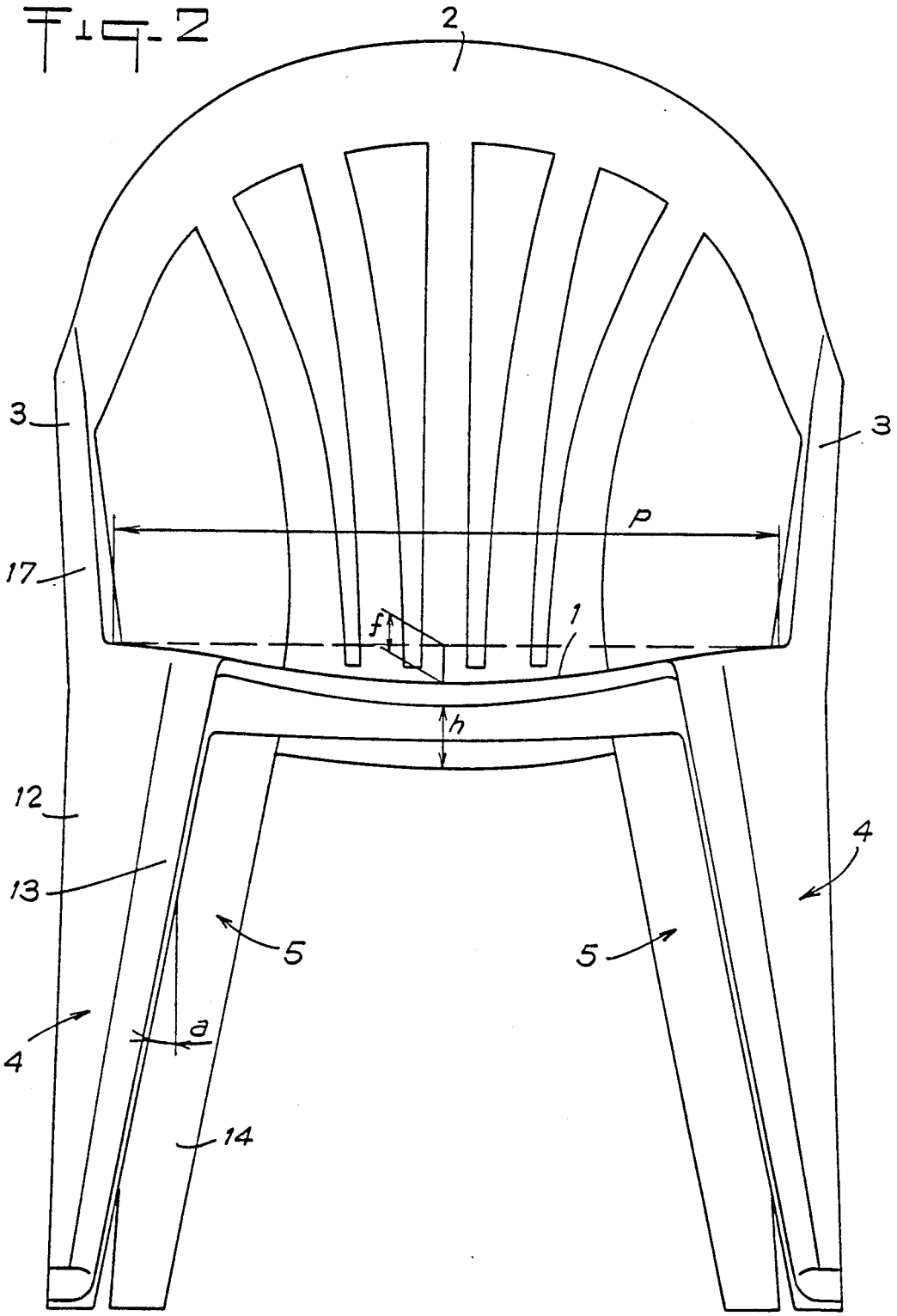
FIG. 2 is a front elevation of the armchair.
Figure 3:
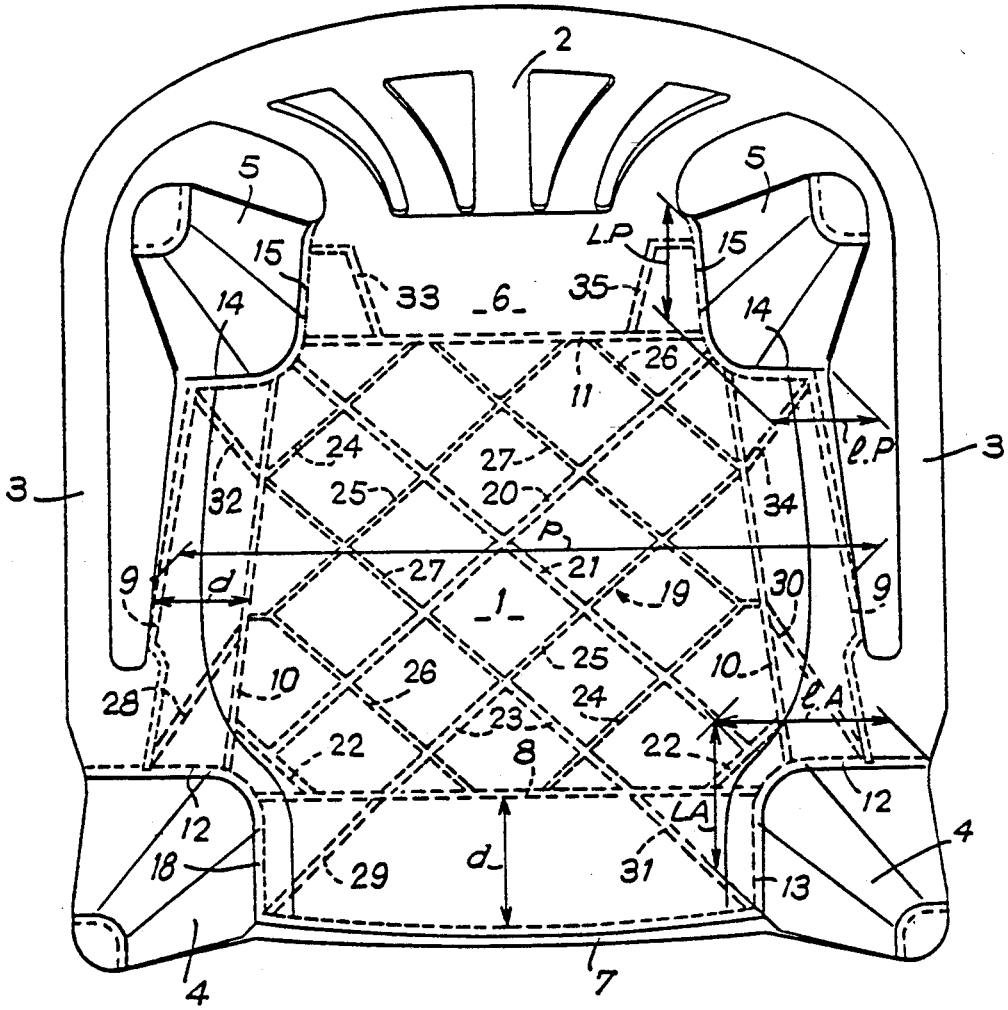
FIG. 3 is a plan view from above of this armchair.

The seat element 1 is shaped as a dish with upwardly directed concavity (FIG. 2) presenting a camber f for a median transverse bearing surface p (FIGS. 2 and 3). This seat element is joined to the backrest 2 by a rounded joining part 6 and comprises, projecting downwardly:

a front edge 7 and a rib 8 substantially parallel to each other, on each side, a lateral edge 9 and a rib 10, substantially parallel to one another, a rear rib 11 substantially parallel to the rounded joining part 6.

The front legs 4 are angles open on the sides and forwardly; in other words, their transverse flanges 12 extend in line with one another towards the outside and are joined by the front rib 8, these transverse flanges 12 being integral with the seat element 1, as well as with the lateral edges 9 and the ribs 10 which are substantially perpendicular thereto; their antero-posterior flanges 13 extend substantially in line with the lateral ribs 10 towards the front and are integral with the seat element 1, as well as with the front edge 7 and the rib 8.

The rear legs 5 are angles open on the sides and towards the rear; in other words, their transverse flanges 14 extend in line with each other towards the outside and are joined by the rear rib 11, these transverse flanges 13 being integral with the seat element 1 as well as with the lateral edges 9 and ribs 10 which are substantially perpendicular thereto; their antero-posterior flanges 15 extend in line with those 13 of the front legs 4 towards the rear, are joined by the lateral ribs 10 and are integral with the seat element 1, the rounded joining part 6 and the rear rib 11.

These legs 4 and 5 are semi-pyramidal in that their base section is smaller than their head section (FIG. 3).

According to the invention, for the pitch of stacking (i.e. the distance of the top of the seat element 1 of a chair above that of the adjacent chair in the stack) to be reduced, the angle "a" of stacking which is that formed by the line of greatest slope of the so-called vertical faces with the vertical, is included between 8 and 15°.

This angle "a" is marked in FIG. 2 for a front leg 4; in this case, it is the angle formed by the antero-posterior flange 13 with the vertical and which is found again for the transverse flange 14 of said leg.

Angle "a" is advantageously substantially equal to 10°30'.

Still according to the invention, the legs, which are more sloping than up to the present time, are more extended at the head so that the distances of the extreme points of attachment (of the subjacent projecting elements 7 to 11 of the seat element 1 and of the overlying rounded joining part 6) are greater and thus reinforce the fits, whilst the height of said elements 7 and 11 is reduced in correspondence with the reduction of the pitch of stacking.

In this way, at the level of the apparent upper surface of the seat element 1 (FIG. 3):

the width 1.A of the transverse flanges 12 of the front legs 4 is included between 85 and 115 mm; advantageously, it measures substantially 95 mm, the width L.A of the antero-posterior flanges 13 of the front legs 4 is included between 75 and 105 mm; advantageously, it measures substantially 85 mm, the width l.p of the transverse flanges 14 of the rear legs 15 is included between 60 and 90 mm; advantageously, it measures substantially 70 mm, the width L.P of the antero-posterior flanges 15 of the rear legs 15 is included between 75 and 105 mm; advantageously, it measures substantially 85 mm.

At the rear, fit of the rear legs 5 is obtained over a greater extent by the rounded joining part 6.

At the front fit of the front legs 4 is obtained more efficiently by the rising part of the armrests 3 which is sectioned as an angle (FIG. 1). The transverse flange of this part extends at its base the transverse flange 12 of the corresponding front leg 4, whilst the antero-posterior flange 17 of said part extends an inwardly hollowed recess 18 in the corresponding lateral edge 9.

Of course, each armrest 3 forms a flying buttress joining the front leg 4 to the backrest 2.

According to the invention, the concavity of the seat element 1 is accentuated, in order that said seat element acts like a shell opposing the flattening of the front legs forwardly and the rear legs rearwardly when a person sits down. In this way, the camber "f" in the median transverse direction is substantially equal to 26 mm for a bearing surface "p" substantially equal to 430 mm and a thickness included between 3 and 4 mm.

Furthermore, as is clearly shown in FIG. 3, the seat element 1 is integral, between the peripheral ribs 8, 10, 11, with a ribbed grid 19 projecting downwardly and rigidifying said seat element. In this way, the root of the legs 4 and 5 is perfectly fitted and said legs tend less to move away from one another outwardly when the armchair is under load although they are inclined more on the vertical when the armchair is at rest.

Grid 19 comprises two relatively thick diagonal ribs 20 and 21 terminating directly on the rear legs 5 and, via hollow wedges 22, at front legs 4. These wedges 22 are constituted by thick slanting elements joining the ribs 8 and 10, at a distance from said legs.

Grid 19 also comprises a V-shaped rib 23 reinforcing the front rib 8.

All these ribs 8 and 11 forming band and 20 to 23 for reinforcing, are joined together and to the seat element 1 by thin ribs 24 to 27 extending parallel to the diagonal ribs 20 and 21 and completing the grid.

In addition, the join of this seat element 1 ridigified by grid 19:

with the front legs 4 is reinforced by slanting ribs 28 to 31, and with the rear legs 5 is reinforced by slanting ribs 32, 33 and angled ribs 34, 35.

For the right front leg 4, rib 28 extends a rib 25, extends between the corresponding edge 9 and rib 10 and terminates on the transverse flange of this leg, whilst the rib 29 extends a rib 23, extends between the corresponding edge 7 and rib 8 and terminates on the antero-posterior flange of said leg, ribs 28 and 29 being parallel to each other.

For the left front leg 4, rib 30 extends a rib 27, extends between the corresponding edge 9 and rib 10 and terminates on the transverse flange of this leg, whilst rib 31 extends a rib 23, extends between the corresponding edge 7 and rib 8 and terminates on the antero-posterior flange of said leg, the ribs 30 and 31 being parallel to each other.

For the right rear leg 5, rib 32 extends a rib 27, extends between the corresponding edge 9 and rib 10 and terminates on the transverse flange of this leg, whilst the angled rib 33 projects beneath the rounded part 6 to join rib 11 to the antero-posterior flange of said leg.

For the left rear leg 5, rib 34 extends a rib 25, extends between the corresponding edge 9 and rib 11 and terminates on the transverse flange of this leg , whilst the angled rib 35 projects beneath the rounded part 6 to join rib 11 to the antero-posterior flange of said leg.

All these marginal ribs 28 to 35 reinforce the fit of legs 4 and 5 in seat element 1.

At least ribs 8, 10 and 11 present a height "h" substantially equal to 23 mm. They are spaced apart from edges 7, 9 by a distance "d" of between 80 and 50 mm.

What is claimed is:

1. A plastic injection molded monolithic chair having a front, sides and a rear, said chair comprising:

a seat joined to a backrest by a rounded joining part, said seat having a plurality of ribs comprising at least one front rib substantially parallel to a front edge, at least two lateral ribs substantially parallel to two lateral edges, at least one rear rib substantially parallel to the rounded joining part, and at least two diagonal ribs;

two front legs having substantially vertical faces, said two front legs being shaped as angles open on the sides and forwardly and comprising transverse flanges and antero-posterior flanges, said transverse flanges extending substantially in line with one another to the sides of said chair and said antero-posterior flanges being connected together by said front edge and said front rib; and two rear legs having substantially vertical faces, said two rear legs being shaped as angles open on the sides and rearwardly and comprising transverse flanges and antero-posterior flanges, said transverse flanges extending substantially in line with one another to the sides of said chair and said antero-posterior flanges being connected together by said rounded joining part and said rear rib, said antero-posterior flanges of said rear legs extending approximately in parallel relation with the antero-posterior flanges of said front legs and said transverse flanges of the front and rear legs being connected together by said lateral edges and said lateral ribs;

the substantially vertical faces of the legs being inclined for the stackage of a plurality of chairs along a vertical axis, and said faces having a line of greatest slope which forms with a vertical line a stacking angle of between 8 degrees and 15 degrees.

2. The chair of claim 1, wherein the seat also comprises rib portions reinforcing the portions of said seat and said ribs, edges and rounded joining part which are integral with said legs.

3. The chair of claim 1, wherein said stacking angle of the legs is substantially 10° 30'.

4. The chair of claim 1 wherein said seat is shaped as a concave dish, said seat further comprising a ribbed grid integral with said front rib, said rear rib, and said lateral side ribs.

5. The chair of claim 1, wherein said ribbed grid comprises intermediate ribs parallel to said diagonal ribs and connected with said front rib, lateral ribs and rear rib.

6. The chair of claim 1, wherein said diagonal ribs terminate at said front legs via an intermediate rib, said intermediate rib forming hollow wedges and joining said lateral side rib and said front rib.

7. The chair of claim 6, further comprising a plurality of slanting ribs, connecting said lateral ribs and said front rib to said front edge and lateral edges.

8. The chair of claim 6, further comprising a plurality of angled ribs connecting said rear rib to the antero-posterior flange of said rear leg and a plurality of slanting ribs connecting said lateral ribs to said lateral edges.

9. The chair of claim 1, wherein said transverse flanges and said antero-posterior flanges have a width at said seat, said width at said seat of said transverse flanges being between about 85 mm and about 115 mm for said front legs and between about 60 mm and about 90 mm for said rear legs, and said width at said seat of said antero-posterior flanges being between about 75 mm and about 105 mm for said front legs and between about 75 mm and about 105 mm for said rear legs.

10. The chair of claim 9, wherein said width at said seat of said transverse flanges is approximately 95 mm for said front legs and approximately 70 mm for said rear legs, and wherein said width at said seat of said antero-posterior flanges is approximately 85 mm for said front legs and approximately 85 mm for said rear legs.

11. The chair of claim 1, further comprising armrests joining each of said two front legs to said backrest.

12. The chair of claim 11, wherein each of said armrests is sectioned as an angle having an armrest transverse flange and an armrest antero-posterior flange, said armrest transverse flange extending said transverse flange of said front leg and said armrest antero-posterior flange extending a recessed hollow part of said lateral edge.

13. The chair of claim 4, wherein said seat forms a camber measuring substantially 26 mm in a median transverse direction, said seat having a bearing surface of substantially 430 mm and a thickness of between about 3 mm and about 4 mm.

14. The chair of claim 1, wherein said front rib and said lateral ribs have a height substantially equal to 23 mm.

15. The chair of claim 14, wherein said front rib and said lateral ribs are spaced apart from said edges by a distance of between about 80 mm and about 50 mm.

* * * * *